US011376609B2

(12) United States Patent
Wiser

(10) Patent No.: US 11,376,609 B2
(45) **Date of Patent: *Jul. 5, 2022**

(54) HIGH VOLTAGE CONNECTION FOR SPARSE MATERIAL

(71) Applicant: Environmental Management Confederation, Inc., Rocky Hill, NJ (US)

(72) Inventor: Forwood C. Wiser, Kingston, NJ (US)

(73) Assignee: Environmental Management Confederation, Inc., Princeton, NJ (US)

( * ) Notice: Subject to any disclaimer, the term of this patent is extended or adjusted under 35 U.S.C. 154(b) by 147 days.

This patent is subject to a terminal disclaimer.

(21) Appl. No.: 15/704,844

(22) Filed: Sep. 14, 2017

(65) Prior Publication Data

US 2018/0001327 A1 Jan. 4, 2018

Related U.S. Application Data

(63) Continuation of application No. 14/945,573, filed on Nov. 19, 2015, now Pat. No. 9,861,990.

(51) Int. Cl.

| | |
|---|---|
| ***B03C 3/66*** | (2006.01) |
| ***B03C 3/09*** | (2006.01) |
| ***B03C 3/155*** | (2006.01) |
| ***B03C 3/70*** | (2006.01) |

(52) U.S. Cl.

CPC ..... *B03C 3/66* (2013.01); *B03C 3/09* (2013.01); *B03C 3/155* (2013.01); *B03C 3/70* (2013.01)

(58) Field of Classification Search

CPC ..... B03C 3/66

See application file for complete search history.

(56) References Cited

U.S. PATENT DOCUMENTS

| | | | | |
|---|---|---|---|---|
| 3,509,696 | A * | 5/1970 | Thompson | B03C 3/155 96/66 |
| 4,886,526 | A * | 12/1989 | Joannou | B03C 3/155 96/67 |
| 5,330,559 | A | 7/1994 | Cheney et al. | |
| 5,474,599 | A * | 12/1995 | Cheney | B03C 3/155 95/63 |
| 5,573,577 | A | 11/1996 | Joannou | |

(Continued)

FOREIGN PATENT DOCUMENTS

| | | |
|---|---|---|
| AU | 713501 B2 | 2/1999 |
| CA | 2826992 | 4/2015 |

(Continued)

OTHER PUBLICATIONS

AU Examination Report No. 1 dated Jan. 29, 2018, as received in Application No. 2015349900.

(Continued)

*Primary Examiner* — Christopher P Jones
*Assistant Examiner* — Sonji Turner
(74) *Attorney, Agent, or Firm* — Schott P.C.

(57) ABSTRACT

A filter assembly for an active field polarized media air cleaner includes a conductive screen that conducts a high voltage therethrough, a probe that delivers voltage to the conductive screen, and a conductive patch adhered to the conductive screen. The probe delivers the high voltage to the conductive screen through the conductive patch.

16 Claims, 4 Drawing Sheets

(56) References Cited

U.S. PATENT DOCUMENTS

| | | | | |
|---|---|---|---|---|
| 6,077,334 | A * | 6/2000 | Joannou | B03C 3/155 96/66 |
| 6,989,051 | B2 | 1/2006 | Parisi et al. | |
| 7,708,813 | B2 | 5/2010 | Wiser et al. | |
| 8,070,861 | B2 * | 12/2011 | Wiser | B01D 46/0032 96/66 |
| 9,861,990 | B2 * | 1/2018 | Wiser | B03C 3/66 |
| 2003/0164095 | A1 | 9/2003 | Joannou | |
| 2010/0326279 | A1 | 12/2010 | Wiser et al. | |
| 2011/0277637 | A1 | 11/2011 | Chesebrough | |
| 2012/0260803 | A1 | 10/2012 | Wiser et al. | |
| 2012/0312170 | A1 | 12/2012 | Noh et al. | |
| 2013/0183201 | A1 | 7/2013 | Wiser et al. | |
| 2016/0144379 | A1 * | 5/2016 | Wiser | B03C 3/66 96/58 |

FOREIGN PATENT DOCUMENTS

| | | | |
|---|---|---|---|
| CN | 101365542 | A | 2/2009 |
| CN | 103049786 | A | 4/2013 |
| DE | 3878306 | T2 | 5/1993 |
| EP | 0337017 | B1 | 9/1993 |
| EP | 3221059 | A1 | 9/2017 |
| KR | 20080109724 | A | 12/2008 |
| WO | 98/20978 | A1 | 5/1998 |
| WO | 2016/081680 | A1 | 5/2016 |

OTHER PUBLICATIONS

CN First Office Action dated Jul. 26, 2018, as received in Application No. 201580063001.3 (English Translation).
Extended European Search Report dated Jun. 27, 2018, as received in Application No. 15861791.0.
International Search Report and Written Opinion of the International Searching Authority for PCT Application No. PCT/US2015/061464 dated Jan. 21, 2016.
International Preliminary Report on Patentability for PCT Application No. PCT/US2015/061464 dated Oct. 31, 2016.
AU Notice of Acceptance dated Nov. 15, 2018, as received in Application No. 2015349900.
Written Opinion dated Mar. 8, 2018, as received in Singapore Application No. 11201704109P.
Written Opinion dated Oct. 15, 2018, as received in Singapore Application No. 11201704109P.
Non Final Office Action received for U.S. Appl. No. 14/945,573, dated May 19, 2017, 13 pages.
Notice of Allowance received for U.S. Appl. No. 14/945,573, dated Sep. 5, 2017, 11 pages.
Corrected Notice of Allowability received for U.S. Appl. No. 14/945,573, dated Sep. 20, 2017, 4 pages.
Office Action received for Chinese Patent Application No. 201580063001.3, dated Jun. 18, 2019, 13 pages including English translation.
First Search report received for Chinese Patent Application No. 201580063001.3, dated Jul. 18, 2018, 2 pages (In English Language Only).
Search Report by Registered organization received for Japanese Patent Application No. 2017-545860, dated Aug. 14, 2019, 24 pages including English Translation.
Notice of Reasons for Refusal for Japanese Patent Application No. 2017-545860, dated Aug. 27, 2019, 6 pages including English Translation.
Notice of Reasons for Refusal for Japanese Patent Application No. 2017-545860, dated Jun. 9, 2020, 6 pages including English Translation.
Communication Pursuant to Article 94(3) EPC issued by the European Patent Office within the European Application No. 15861791.0, dated Sep. 30, 2021, 9 pages.
Examination Report issued by the Australian Government IP Australia within the Australian patent Application nu. 2019201414, dated Apr. 27, 2021, 6 pages.
Translation of Notification of Reexamination issued by the National Intellectual Property Administration of the Peoples' Republic of China (CNIPA) within CN Patent Application No. 201580063001.3, dated Nov. 2, 2021, 8 pages.
English Translation of Korean Office Action Issued from Korean Intellectual Property Office within the Korean Patent Application No. 10-2017-7015502, dated Feb. 17, 2022, 9 pages.
Translation of First Examination Report Part II—Response and Detailed Technical Report of FER Issued within the Indian Application No. 201717020309, dated Dec. 31, 2021, 10 pages.

* cited by examiner

HIGH VOLTAGE CONNECTION FOR SPARSE MATERIAL

The following application is a continuation of U.S. application Ser. No. 14/945,573, filed on Nov. 19, 2015, which is incorporated herein by reference in its entirety.

BACKGROUND

The principal of electrostatic attraction has been used for many years to enhance the removal of contaminants from air streams. There are three primary categories of air electrostatic cleaners: electrostatic precipitators, passive electrostatic filters and active field polarized media air cleaners, which are sometimes known under different terms.

Electrostatic precipitators charge particles and then capture them on oppositely charged and/or grounded collection plates.

A passive electrostatic filter (also know as an electret) employs a media (or combination of different media) that through some combination of treatment and/or inherent properties has an electrostatic charge. Particles entering the filter media that have an electrostatic charge are attracted to the charged media filter materials that have the opposite electrostatic charge.

In a polarized media air cleaner described for example in U.S. Pat. No. 7,708,813 and 2012/0260803, both of which are incorporated by reference as if fully set forth herein, a voltage differential between elements is used to create an electrostatic field that polarizes the fibers of a media pad and the surface charge of airborne contaminants. This significantly enhances capture and loading of the contaminants. In these systems, there is a high voltage connection between a high-voltage power supply and a probe centrally-located conductive screen of a media pad positioned between grounded exterior screens. The connection is critical to the function of the overall system as the voltage differential between the center screen and the ground screen(s) creates the electrostatic field. This connection point, however, can be a weak point in the system and may fail, rendering the polarizing feature in the air cleaner ineffective.

The reason that this can be a failure point is because the filter material itself is often a sparse material. Because air must pass through the system with as little resistance as possible, screens and other materials in a filter may be made from sparse material. This does not make for a solid electrical connection. Further, some of the byproducts of an incomplete connection are arcing, ionization, and ozone production. All of these will tend to breakdown a variety of materials and further exacerbate the problem. Therefore, if the center screen is a relatively sparse material and the high-voltage probe is relatively small, it may be difficult to assure a reliable connection between the two.

Thus, any object connected to the material—including a conductive probe—becomes a stress point in a sparse and minimally tough material.

SUMMARY OF THE EMBODIMENTS

This connection point is critical to a polarized air cleaner's performance. The current invention relates to making good electrical contact between an electrical source and a relatively sparse filter material.

A filter assembly for an active field polarized media air cleaner includes a conductive screen that conducts a high voltage therethrough, a probe that delivers voltage to the conductive screen, and a conductive patch adhered to the conductive screen. The probe delivers the high voltage to the conductive screen through the conductive patch.

DETAILED DESCRIPTION OF THE EMBODIMENTS

An active field polarized media air cleaner uses an electrostatic field created by a voltage differential. The electrostatic field polarizes both the media fibers and the particles that enter, thereby increasing the removal efficiency of the media as well as the loading capacity of the air cleaner. A dielectric material is an electrical insulator or a substance that is highly resistant to electric current that can also store electrical energy. A dielectric material tends to concentrate an applied electric field within itself and is thus an efficient supporter of electrostatic fields.

Figure 1:
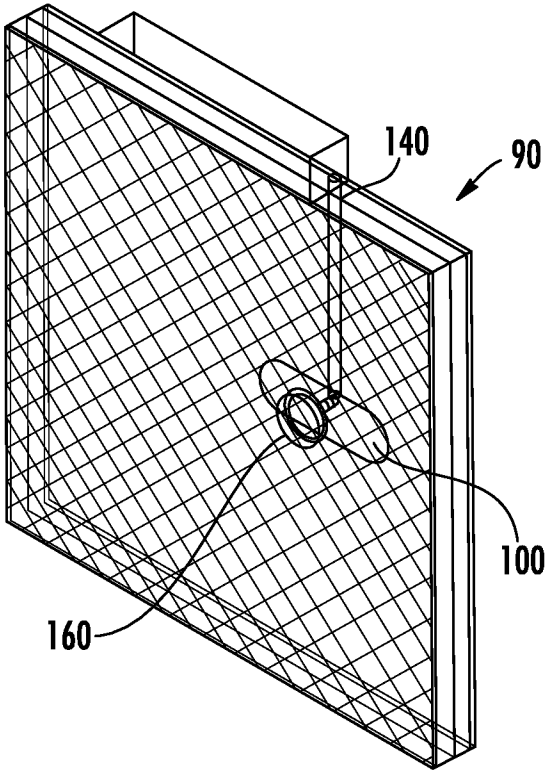
FIG. 1 shows an isometric view of the conductive disc applied to a screen, with certain elements shown transparently for clarity.
Figure 2:
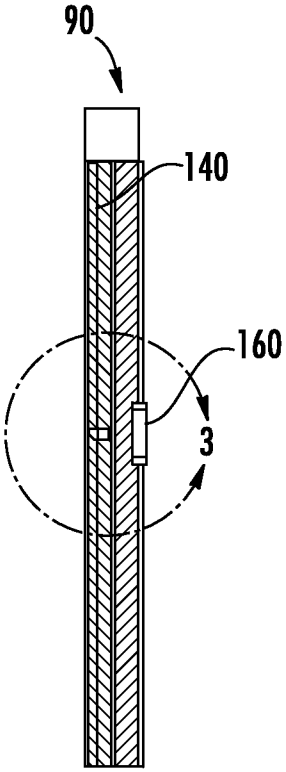
FIG. 2 is a cross-sectional side view of FIG. 1.
Figure 3:
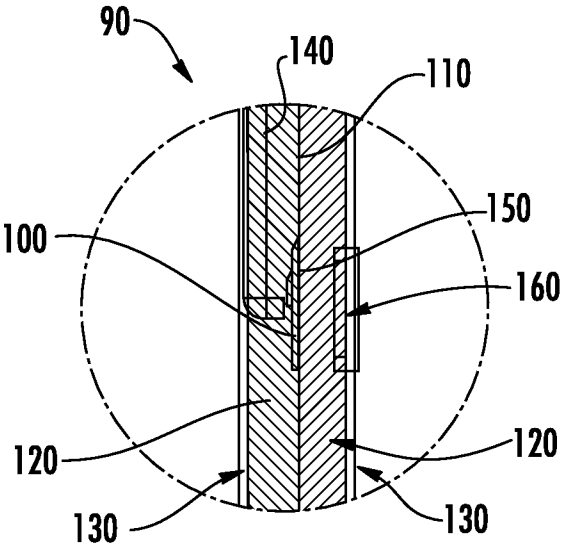
FIG. 3 is an enlarged cross-section of FIG. 1.

Conductive adhesive patches 100 will improve and ensure the connection point between a conductive center screen 110 sparse material and a probe 140, as shown in FIG. 1. The conductive patches 100 can be metal foil or sheet, and may be include a plastic backing to ensure they keep a uniform shape. If the patch 100 is backed with a plastic material, the plastic material would include a passthrough to allow the patch to receive a charge from a conductive probe 140.

The conductive patches 100 could be any conductive material. Aluminum foil adhesive tapes and die-cut parts are a readily available and inexpensive option that is presently preferred. The figures show a circular-shaped piece of aluminum foil applied to and extruded conductive plastic netting, but could obviously be applied to other material types and shapes.

In use, the adhesive-backed conductive patch 100 attaches to a conductive center screen 110 that separates two filter media 120. Ground screens 130 on either side of the filter media 120 act to ground the entire filter assembly 90. A probe 140 delivers voltage from a voltage source through the filter assembly 90 to the conductive patch 100.

The voltage contact between the probe 140 and the conductive patch 100 is made through a contact point 150 on the probe 140. The contact point 150 could have a sharp point and pierce the media 120 and the patch 100. Alternatively, the contact point 150 could be blunt or rounded and simply make contact with the patch 100. The contact point 150 may itself have some adhesive applied thereto that contacts the patch 100 to minimize the chance of a lost connection. This adhesive would itself either be conductive or only surround the contact point, not insulated the contact point more than necessary. Alternatively, the contact point 150 and patch 100 may be connected through a magnetic connection.

In some instances, the media 120 would have to be sparse enough to allow for contact therethrough. Alternatively, the media may be cut away to allow a clear path for the probe.

In one embodiment, there may be an insulating element 160 on the opposite ground screen 130 in an area proximate to the contact to prevent short of the high voltage to ground. This insulating element 160 could also be attached to the center of the filter media 120 or elsewhere. Another embodiment of an insulating element could act as a spacer located on an opposite side of the center screen 110 from the patch, where the spacer ensures the center screen does not short.

Figure 6:
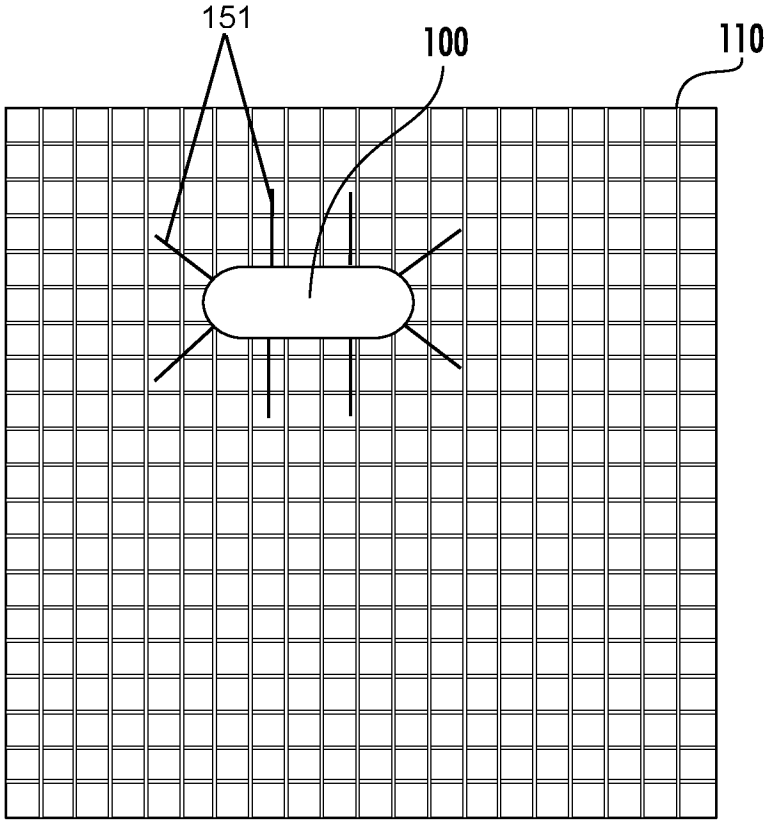
FIG. 6 shows an alternate embodiment of the disc applied to a single side of a conductive screen.

As shown, the conductive patch 100 is oblong and planar to allow for some variability in placement with different sizes and types of media pads and filter frames. The conductive patch 100 could be smaller if the relationship between the filter assembly 90 and the high voltage probe 140 was uniform. The conductive patch 100's rounded edges minimize the potential of voltage spraying and arcing. The patch 100 may also be a splined shape with arms 151 that extend outwards from a center as shown in FIG. 6.

Figure 4C:
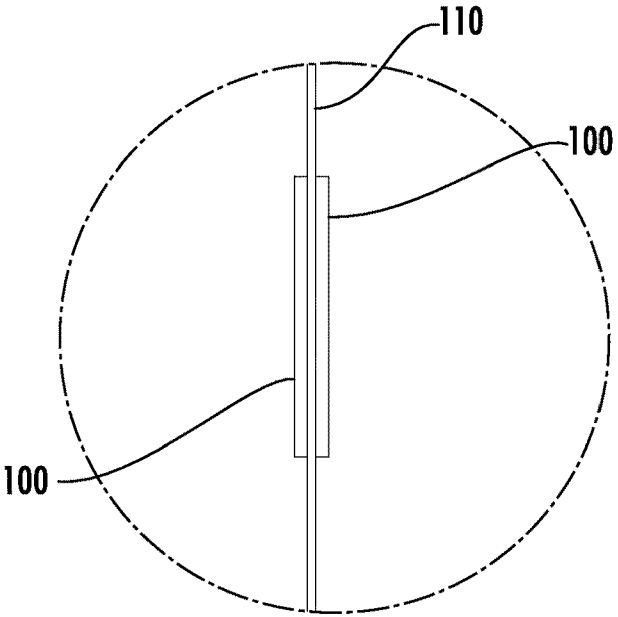
FIGS. 4*a-c* show different views of the disc applied to both sides of a conductive screen.
Figure 4B:
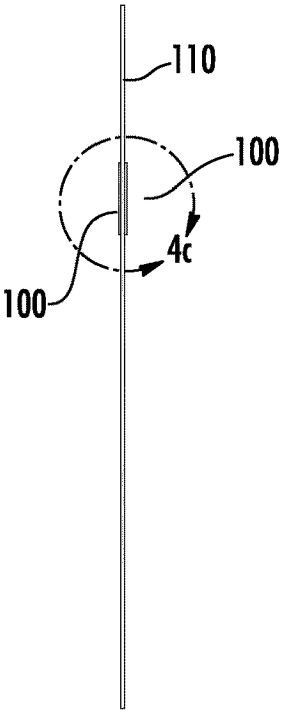
Figure 4A:
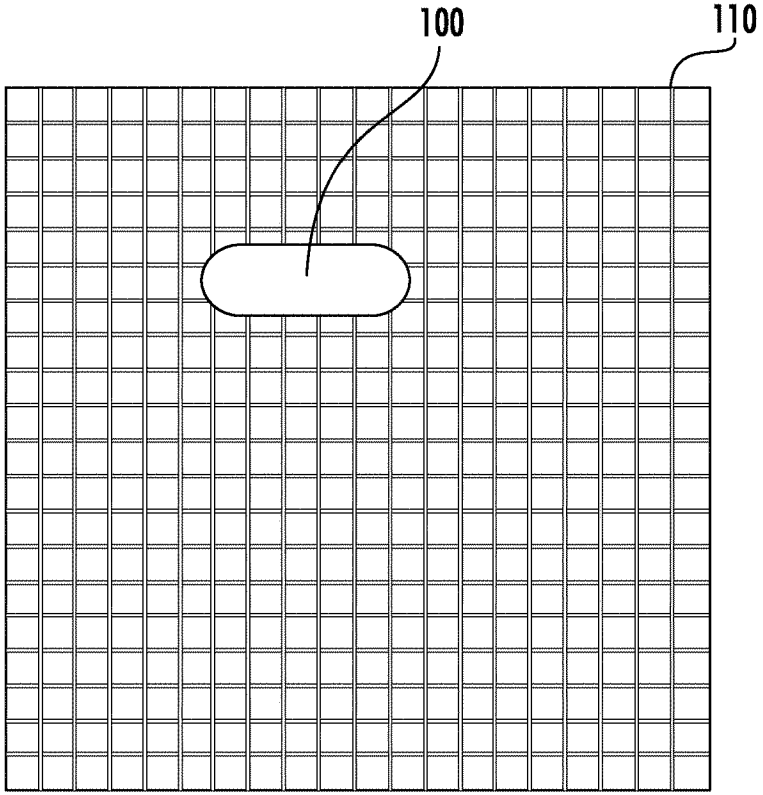
Figure 5C:
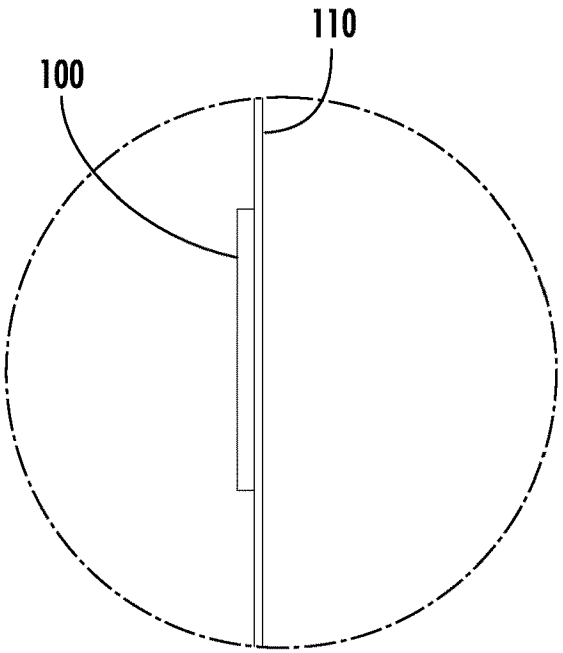
FIGS. 5*a-c* show different views of the disc applied to a single side of a conductive screen.
Figure 5B:
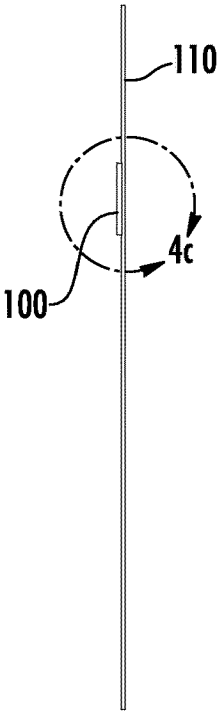
Figure 5A:
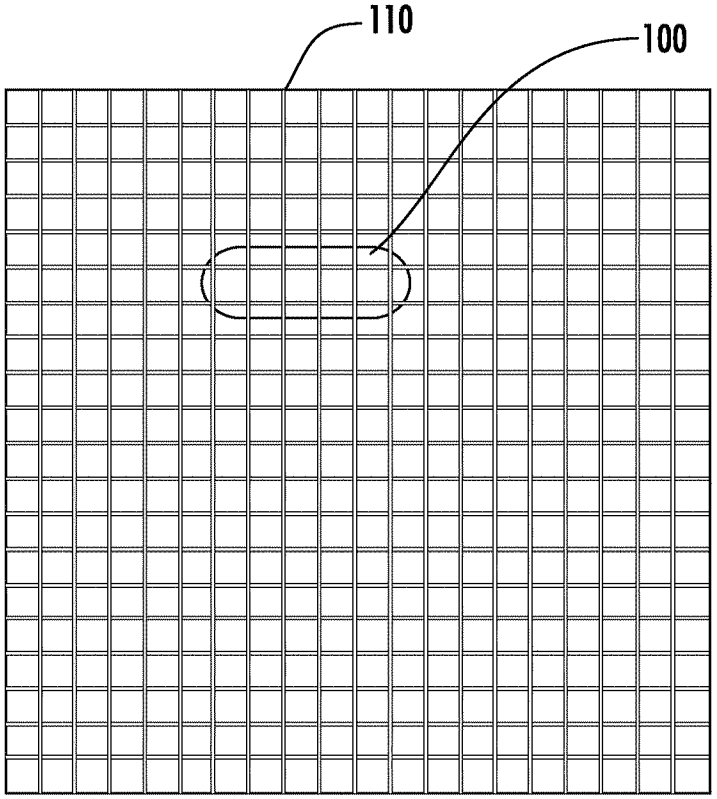

The conductive patch 100 could be applied to both sides of the center screen 110 (first and second patches applied separately) as shown in FIGS. 4*a-c* or to one side as shown in FIGS. 5*a-c*. The advantage of the former would be in the event of a sparser center screen 110 material, the two patches 100 would hold each other in place through the connection of their adhesives to one another through the gaps in the center screen 110. Alternatively, the patch 100 opposite the probe 140 could be made of an insulating material and could serve to replace the insulating element 160. The center screen 110 itself could be any of a variety of conductive materials.

While the embodiments shown relate to air cleaners, there will be other applications for such a contact where a positive electrical connection to a sparse or woven material or substrate or extruded plastic net is required.

While the invention has been described with reference to the embodiments above, a person of ordinary skill in the art would understand that various changes or modifications may be made thereto without departing from the scope of the claims.

The invention claimed is:

1. A filter assembly for an active field polarized media air cleaner comprising:

a conductive screen that conducts a voltage therethrough;

a probe that delivers voltage to the conductive screen having a first side and a second side, wherein the probe includes a rounded contact point;

a first conductive, planar patch adhesively attached to the conductive screen first side, wherein the probe is located on the conductive screen first side and delivers the voltage to the conductive screen through contact with the first conductive, planar patch, wherein the first conductive, planar patch is a separate and distinct element from the conductive screen; and a second conductive patch applied to an opposite side of the conductive screen, wherein the second conductive patch is in electrical contact with the first conductive, planar patch;

wherein the second conductive patch is adhesively connected to the first conductive, planar patch through gaps in the conductive screen.

2. The filter assembly of claim 1, further comprising filter media located on either side of the conductive screen.

3. The filter assembly of claim 2, further comprising ground screens on either side of the conductive screen.

4. The filter assembly of claim 3, further comprising an insulating element attached to one of the ground screens in an area of one of the ground screen near the probe, wherein the insulating element prevents a short of the voltage to ground.

5. The filter assembly of claim 2, wherein at least one of the filter media includes a hole therethrough, wherein the probe extends through the hole to contact the first conductive, planar patch.

6. The filter assembly of claim 1, further comprising a ground screen that grounds the assembly.

7. The filter assembly of claim 1, wherein the first conductive, planar patch comprises an aluminum foil.

8. The filter assembly of claim 1, wherein the first conductive, planar patch comprises a metal sheet.

9. The filter assembly of claim 1, wherein the first conductive, planar patch comprises a conductive plastic.

10. The filter assembly of claim 1, wherein the first conductive, planar patch comprises a conductive portion attached to a backing.

11. The filter assembly of claim 1, wherein the first conductive, planar patch has rounded edges.

12. The filter assembly of claim 1, wherein the first conductive, planar patch comprises a splined shape with arms that extend outwards from a center of the first conductive, planar patch.

13. The filter assembly of claim 1, wherein the probe and first conductive, planar patch are in contact through an adhesive.

14. The filter assembly of claim 1, wherein the second conductive patch applied to an opposite side of the conductive screen is made of an insulating material.

15. The filter assembly of claim 1, further comprising an insulating spacer on an opposite side of the conductive screen.

16. The filter assembly of claim 1, wherein the first conductive, planar patch is oblong.

* * * * *